United States Patent [19]

Rothrock

[11] Patent Number: 4,936,552

[45] Date of Patent: Jun. 26, 1990

[54] AERATING APPARATUS

[76] Inventor: Charles E. Rothrock, 2337 Nederland Ave., Port Neches, Tex. 77651

[21] Appl. No.: 343,829

[22] Filed: Apr. 27, 1989

[51] Int. Cl.[5] ..... B01F 3/04

[52] U.S. Cl. ..... 261/76; 261/DIG. 75; 138/DIG. 3

[58] Field of Search ..... 261/DIG. 75, 76; 138/DIG. 3, 146

[56] References Cited

U.S. PATENT DOCUMENTS

| | | | |
|---|---|---|---|
| 2,020,850 | 11/1935 | Myhern et al. | 261/DIG. 75 |
| 2,241,337 | 5/1941 | Work | 261/DIG. 75 |
| 2,366,354 | 1/1945 | Robbins | 261/DIG. 75 |
| 2,907,103 | 10/1959 | Lewis et al. | 138/DIG. 3 |
| 3,192,146 | 6/1965 | Vellas et al. | 261/DIG. 75 |
| 3,640,516 | 2/1972 | Willinger | 261/DIG. 75 |
| 3,957,633 | 5/1976 | Gatti et al. | 261/DIG. 75 |
| 3,996,139 | 12/1976 | Prince et al. | 261/DIG. 75 |
| 4,210,534 | 7/1980 | Molvar | 261/DIG. 75 |
| 4,278,405 | 7/1981 | Angle | 261/DIG. 75 |
| 4,308,138 | 12/1981 | Woltman | 261/DIG. 75 |

*Primary Examiner*—Tim Miles

*Attorney, Agent, or Firm*—Bill B. Berryhill

[57] ABSTRACT

Apparatus for aerating fluids passing therethrough including an elongated housing having a cylindrical inlet section and a cylindrical outlet section connected by a chamber section having at least one air port through the walls thereof. A converging frustoconical nozzle is concentrically disposed within the inlet and chamber sections so that fluid passing therethrough mixes with air drawn through the air port for discharge through the outlet section.

10 Claims, 1 Drawing Sheet

AERATING APPARATUS

BACKGROUND OF THE INVENTION

1. Field of the Invention

The present invention pertains to apparatus for aerating fluids. Specifically, it pertains to apparatus for mixing air with waste water and other fluids to increase the oxygen content thereof.

2. Description of the Prior Art

It has been known for many years that the introduction of air or oxygen into sewage or other effluents helps to set up an aerobic action reducing biological oxygen demand and total suspended solids to safe levels for disposal. This may also result in reducing odors of waste water to an acceptable level.

Many systems for such treatment of waste water utilize aspirating nozzles for introducing air or oxygen into the effluent. Some examples of such may be seen in U.S. Pat. Nos. 3,271,304; 3,957,633; 4,166,790; 4,308,138 and 4,440,645. These systems are of differing designs, characteristics and advantages.

SUMMARY OF THE PRESENT INVENTION

In the present invention, apparatus is provided for aerating of fluids passing therethrough. The apparatus may include an elongated housing having a cylindrical inlet section and a cylindrical outlet section connected by a chamber section. The chamber section is preferrably polygonal in shape and has at least one air port through the walls thereof. A converging frustoconical nozzle is concentrically disposed within the inlet and polygonal chamber sections thereof so that a polygonal annular chamber is formed around the nozzle near its exit. When fluids are forced through the nozzle, a partial vacuum is created in the annular chamber inducing air through the air port for mixing with the fluids as the fluids flow through the housing outlet section for exit therefrom. In waste water treatment, the apparatus is connected by piping to the discharge of a pump the intake of which is in fluid communication with the waste water to be treated. The apparatus of the present invention may also be utilized in fish farming by connecting to the discharge of a pump the intake of which is in fluid communication with a reservoir in which fish are contained.

The design of the aerating apparatus of the present invention is such as to reduce frictional flow therethrough. This, in turn, results in longer life of the parts thereof as well as reduced energy costs for pumping the fluids therethrough. In addition, the hexagonal chamber design results in a greater amount of air being induced through the chamber for mixing with fluids passing through the nozzle. Many other objects and advantages of the invention will be understood from reading the description which follows in conjunction with the accompanying drawings.

DESCRIPTION OF A PREFERRED EMBODIMENT OF THE INVENTION

Figure 1:
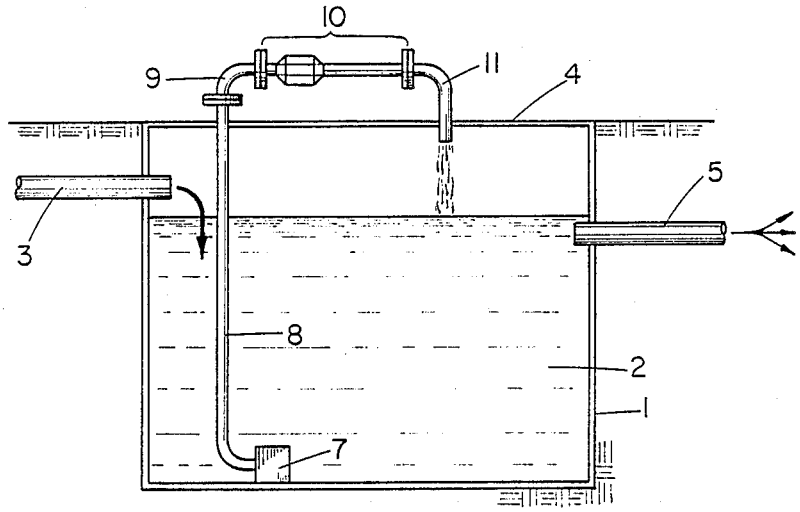
FIG. 1 is an elevation view, partially in section, showing the aerating apparatus of the present invention, according to a preferred embodiment thereof, for use in treating waste water.

Referring first to FIG. 1, there is shown an underground storage tank 1 for receiving waste water and sewage 2 discharged thereinto from a pipe 3. The tank 1 is closed by a cover 4. Disposed near the bottom of the tank 1 is a submersible pump 7 the discharge of which is connected by piping 8 and a pipe ell 9 to the intake of aerating apparatus 10. The outlet of aerating apparatus 10 is connected to an ell 11 which discharges back into the tank 1. It is also noted that the tank 1 is provided with a pipe 5 through which effluent from the tank 1 may flow.

Figure 2:
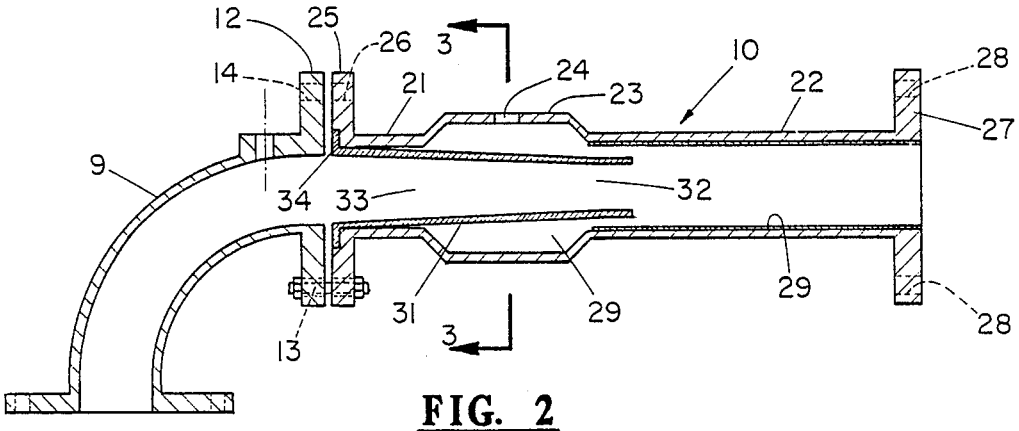
FIG. 2 is a sectional elevation view of aerating apparatus, according to a preferred embodiment of the invention.
Figure 3:
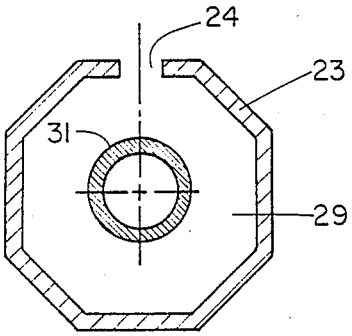
FIG. 3 is a cross-sectional view of the apparatus of FIG. 2 taken along lines 3—3 thereof.

Referring now also to FIGS. 2 and 3, it will be seen that the aerating apparatus 10 includes an elongated housing having a cylindrical inlet section 21 and a cylindrical outlet section 22 connected therebetween by a polygonal chamber section 23. At least one port 24 through the walls of the polygonal chamber 23 provides communication with the air in the environment surrounding the apparatus 10. The inlet section 21 may be provided with a flange 25 for connection with the corresponding flange 12 of the ell 9. Bolts 13 may be placed in holes 14 and 26 to make this connection. A flange 27 at the opposite end of the housing is provided with holes 28 for similar connection with the ell 11 of FIG. 1.

A converging frustoconical nozzle 31 is concentrically disposed within the inlet and polygonal chamber sections 21, 23 so that a polygonal annular chamber 29 is formed around the nozzle 31 near the exit 32 thereof. The nozzle 31 may be provided with a radially extending flange 34 around the entrance 33 thereof. This flange 34 may be received in a corresponding recess of the flange 25 for holding the nozzle 31 in place. It should be noted that the nozzle 31 may be removable through the inlet section 21 of the housing if the ell 9 is disconnected therefrom.

Since the nozzle 31 will be subjected to relatively high fluid velocities as well as solids, it is preferrably made of a highly wear resistant material. It has been found if the nozzle 31 is made of a urethane substance such as the substance called by the trade name HEXCEL URALITE 3160, many years of trouble free operation will result. In addition, the outlet section 22 of the housing may be provided with a sleeve or liner 29 of friction reducing material such as polyvinylchloride (PVC). The reduced friction of the materials of the nozzle 31 and liner 29 result in increased flow which results in increased air aspiration through the air port 24.

In operation, waste water is pumped by the submersible pump 7 through piping 8, 9 for flow through the aerating apparatus 10. As is well known from principles of fluid dynamics, the flow of fluids through the nozzle 31 will increase its velocity and result in the creation of a partial vacuum around the exit thereof. Due to the partial vacuum created by the nozzle, air is induced through the air port 24 and annular chamber 29 into the fluid stream passing through the outlet section 22. Thus, oxygen is returned to the tank 1 helping to set up increased aerobic action in the waste water and sewage 2. As circulation continues from the tank through the aerating apparatus 10 and back into the tank 1, the biological oxygen demand (BOD) and total suspended solids (TSS) are reduced to safe levels. In addition, odors are reduced to acceptable levels. The resulting effluents may then be discharged through the piping 5 for ground disposal and, in some cases, for irrigation. The present unit is designed to bring home owner septic systems down to a standard less than thirty BOD and TSS'S.

A description of a preferred embodiment of the invention has been given for use with a waste water treatment facililty. The same aerating apparatus 10 may be utilized in circulating and aerating water from a large fish tank. This would be particularly useful in the rapidly growing fish farming industry. While a single embodiment of the invention has been described herein, many variations thereof can be made without departing from the spirit of the invention. Accordingly, it is intended that the scope of the invention be limited only by the claims which follow.

I claim:

1. Apparatus for aerating fluids passing therethrough comprising:

a tubular housing having a cylindrical inlet section and a cylindrical outlet section between which is an enlarged chamber section, said chamber section having at least one air port through the walls thereof; and a converging frustoconical nozzle concentrically disposed within said tubular housing and the entrance of which substantially conincides with the entrance to said housing inlet section, said nozzle extending through said housing chamber section and having an exit within said housing outlet section so that when fluids are forced through said nozzle a partial vacuum is created in said chamber section inducing air through said air port for mixing with said fluids as they exit from said nozzle and flow through said housing outlet section, the flow area of said housing outlet section being unrestricted from said chamber section to the exit end thereof.

2. Aerating apparatus as set forth in claim 1 in which said housing chamber section is polygonal in cross-sectional flow area.

3. Aerating apparatus as set forth in claim 1 in which said nozzle is removable through said entrance of said housing inlet section for repair or replacement.

4. Aerating apparatus as set forth in claim 1 including a sleeve member of reduced friction material lining the interior of said housing outlet section to reduce frictional flow therethrough and wear thereof.

5. Apparatus for aerating fluids passing therethrough comprising:

an elongated housing having a cylindrical inlet section and a cylindrical outlet section connected by a polygonal chamber section having at least one air port through the walls thereof; and a converging frustconical nozzle concentrically disposed within said inlet and polygonal chamber sections so that a polygonal cross-sectioned annular chamber is formed around said nozzle near the exit thereof, a partial vacuum being created in said annular chamber when fluids are forced through said nozzle inducing air through said air port for mixing with said fluids as said fluids flow through said housing outlet section for exit from said housing, the flow area of housing outlet section being unrestricted from said chamber section to the exit end thereof.

6. Aerating apparatus as set forth in claim 5 in which said housing outlet section is lined with a friction reducing material to increase the life of said housing.

7. Aerating apparatus as set forth in claim 5 in which said nozzle is provided with a radially extending flange around the entrance thereof and by which said nozzle may be held in place by mating connectors provided on said housing and piping connected thereto.

8. Aerating apparatus as set forth in claim 7 in which said nozzle is removable through one end of said housing for replacement or repair.

9. Aerating apparatus as set forth in claim 5 in which said housing is connected by piping to the discharge of a pump the intake of which is in fluid communication with waste water for aeration thereof.

10. Aerating apparatus as set forth in claim 5 in which said housing is connected by piping to the discharge of a pump the intake of which is in fluid communication with a reservoir for fish living therein.

* * * * *